US005125794A

United States Patent [19]

Detanne

[11] Patent Number: 5,125,794

[45] Date of Patent: Jun. 30, 1992

[54] IMPULSE TURBINE STAGE WITH REDUCED SECONDARY LOSSES

[75] Inventor: François Detanne, Paris, France

[73] Assignee: GEC Alsthom SA, Paris, France

[21] Appl. No.: 699,127

[22] Filed: May 13, 1991

[30] Foreign Application Priority Data

May 14, 1990 [FR] France ..... 90 05992

[51] Int. Cl.[5] ..... F01D 5/18

[52] U.S. Cl. ..... 415/115; 415/116; 415/914

[58] Field of Search ..... 415/115, 116, 175, 176, 415/170.1, 173.1, 914; 416/90 R, 91, 97 R

[56] References Cited

U.S. PATENT DOCUMENTS

| | | | |
|---|---|---|---|
| 3,791,758 | 2/1974 | Jenkinson | 415/116 |
| 4,453,888 | 6/1984 | Hovan et al. | 416/97 R |
| 4,666,368 | 5/1987 | Hook, Jr. et al. | 415/115 |
| 4,674,955 | 6/1987 | Howe et al. | 415/115 |
| 4,708,588 | 11/1987 | Schwarz et al. | 415/115 |
| 4,761,116 | 8/1988 | Braddy et al. | 416/97 R |
| 4,882,902 | 11/1989 | Reigel et al. | 415/115 |

FOREIGN PATENT DOCUMENTS

| | | | |
|---|---|---|---|
| 962601 | 2/1975 | Canada | 416/97 |
| 863152 | 1/1953 | Fed. Rep. of Germany . | |
| 2357326 | 5/1975 | Fed. Rep. of Germany | 415/116 |
| 2381179 | 9/1978 | France . | |
| 2638206 | 4/1990 | France . | |
| 14161 | 4/1985 | Japan . | |
| 529914 | 12/1972 | Switzerland . | |
| 751011 | 6/1956 | United Kingdom . | |
| 1230325 | 4/1971 | United Kingdom | 415/116 |
| 2062118 | 5/1981 | United Kingdom . | |
| 1605282 | 12/1987 | United Kingdom . | |

OTHER PUBLICATIONS

W. Traupel: "Termische Turbomaschinen" 1977, Springer Verlag, Berlin.

Power, vol. 133, No. 6, Jun. 1989, New York, USA: "Steam turbines and auxiliaries."

*Primary Examiner*—John T. Kwon

*Attorney, Agent, or Firm*—Sughrue, Mion, Zinn, Macpeak & Seas

[57] ABSTRACT

An impulse turbine stage comprising a set (1) of fixed vanes (2) fixed to the stator (3) of the turbine and supporting a diaphragm (4), followed by a set (7) of moving vanes (8) mounted on a disc (9) fixed to the rotor (6) of the turbine, the stage being characterized in that said disk (9) is provided with through ducts (12) parallel to the axis of the rotor (6) and in that the inlets to the ducts (12) opening out into the gap between the diaphragm (6) and the disk (9) are provided with scoops (15) open sideways in the direction of rotation to direct fluid into the ducts (12). The invention serves to reduce the secondary losses of an impulse turbine.

4 Claims, 2 Drawing Sheets

IMPULSE TURBINE STAGE WITH REDUCED SECONDARY LOSSES

The present invention relates to an impulse turbine stage comprising a set of fixed vanes fixed to the stator of the turbine and supporting diaphragm, followed by a set of moving vanes mounted on a disk fixed to the rotor of the turbine.

It is conventional for the leakage between the diaphragm of the stationary set and the rotor to be reinjected into the base of the moving vanes. This reinsertion of the leakage flow disturbs a flow which is already highly disturbed at the roots of these vanes, thereby giving rise to a significant loss of efficiency due to these secondary losses, particularly with short vanes.

Document JA-B-14161/85 published Apr. 11, 1985 describes impulse turbine stages in which the moving disks are provided with transverse ducts parallel to the axis of the rotor.

However, this solution is unsuitable for impulse turbines in which there is no pressure difference between the two face of the disk supporting the moving vanes.

The impulse turbine stage of the invention for reducing leakage flow reinjection and thus increasing efficiency is characterized in that said disk is provided with through ducts parallel to the axis of the rotor and in that the inlets to said ducts opening out into the gap between the diaphragm and the disk are provided with scoops open sideways in the direction of rotation to direct fluid into the ducts.

The present invention will be better understood in the light of the following description, in which.

Figure 1:
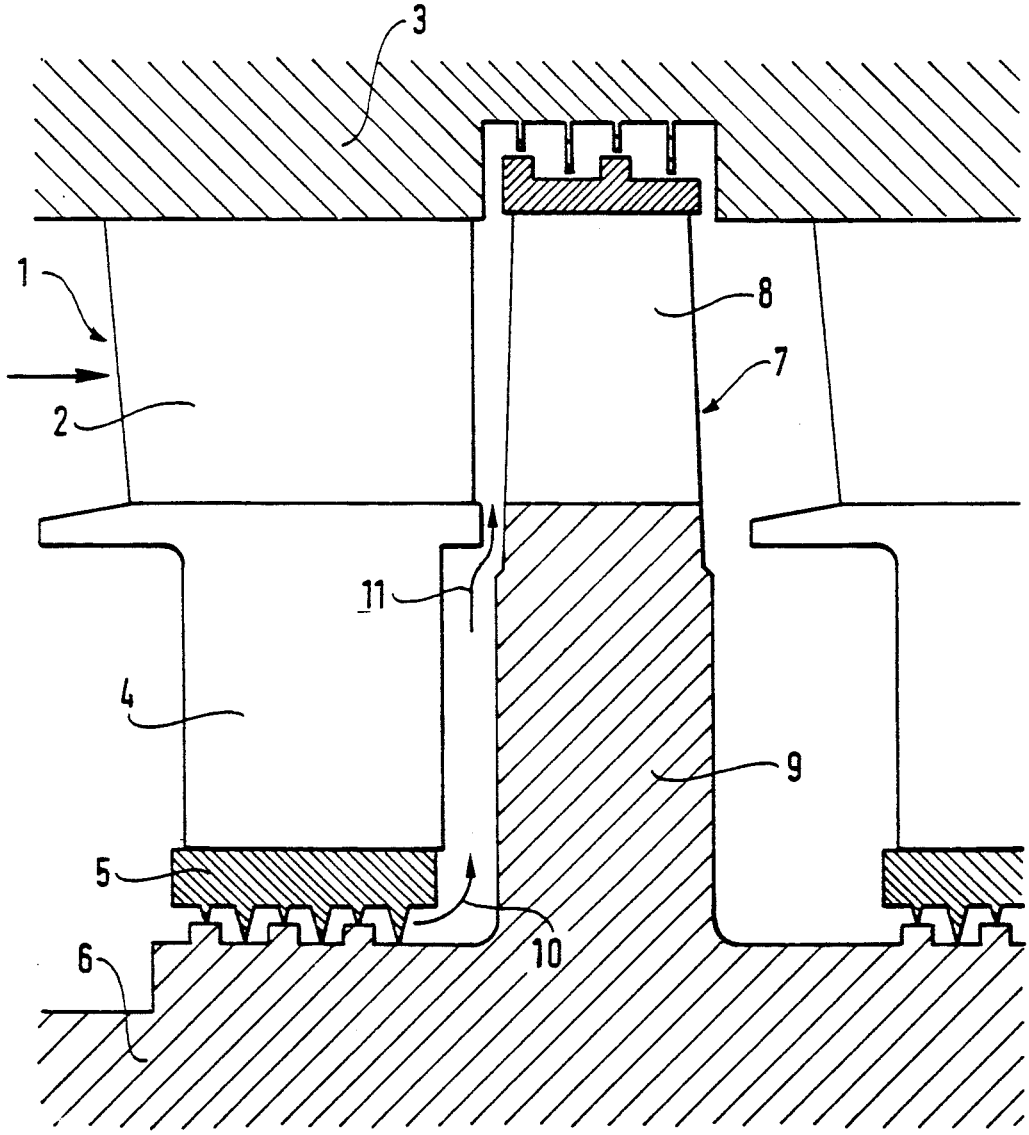
FIG.1 PRIOR ART
FIG. 1 shows a prior art turbine stage.

The prior art impulse turbine stage (FIG. 1) comprises a set 1 of fixed vanes 2 fixed to the stator 3. This set 1 supports a diaphragm 4 provided with sealing means 5 facing the rotor 6 of the turbine.

The set 1 is followed by a set 7 of moving vanes 8 carried by a disk 9 fixed to the rotor 6.

A leakage flow 10 coming from upstream of the diaphragm 4 passes through the sealing means 5 and is injected as a flow 11 to the roots of the moving vanes 8. This flow 11 disturbs the main flow and therefore reduces efficiency. Such reduction is very significant with vanes 8 that are stubby (small ratio of height to chord).

Figure 2:
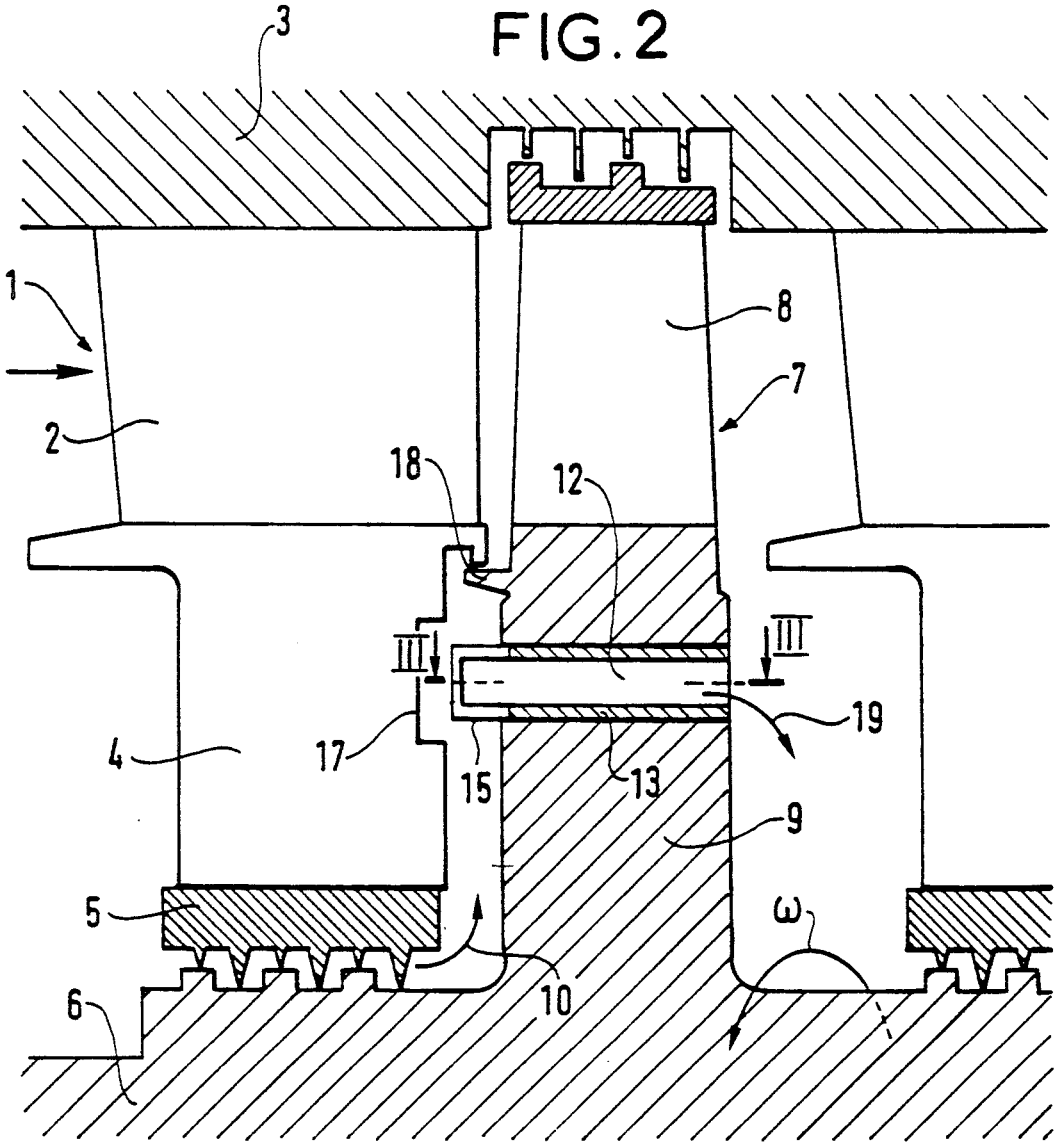
FIG. 2 shows a turbine stage of the invention.

In the turbine stage of the invention (FIGS. 2 to 4) components that are identical to the prior art stage are referenced in identical manner.

The disks 9 are provided with through ducts 12 disposed at a common distance R from the axis of the rotor and parallel thereto. Hollow thimbles 13 are disposed in these ducts, lying flush with the downstream face of the disk 9 and projecting from its upstream face.

Half of the base 14 and half of the cylindrical portion of each projecting thimble 13 are removed down to an axial plane of the turbine, thereby having the effect of providing each of the ducts with a scoop 15.

Figure 3:
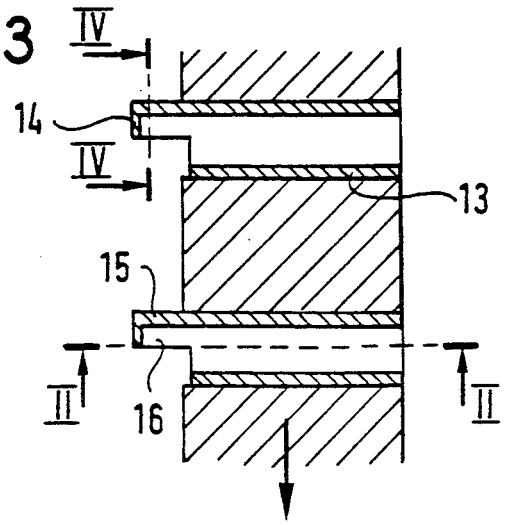
FIG. 3 is a fragmentary cylindrical section of FIG. 2.
Figure 4:
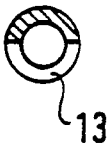
FIG. 4 is a fragmentary radial section of FIG. 3.

The lateral orifices 16 of the scoops 15 face forwards in the direction of rotation of the disk 9 as shown by the arrow in FIG. 3 so as to obtain a pressure increase from the energy corresponding to the relative velocity of the fluid relative to the disk 9, i.e.:

$$@o(V-U)^2$$

where:

V = the velocity of the fluid between the diaphragm and the disk;

U = Rw equals the velocity of the disk level with the ducts;

w = the angular velocity of the disk; and o = the density of the steam.

This pressure increase causes the fluid to move along the ducts 12 from the upstream face to the downstream face of the disk 9.

The efficiency of the scoops 15 is increased by having a circumferential groove 17 formed in the diaphragm 4 facing the row of scoops 15.

Sealing means 18 between the periphery of the disk 9 carrying the moving vane 8 and the facing portion of the diaphragm 4 further reduce any risk of a portion of the leak being reinjected into the moving set of vanes 7. This makes it possible to separate the high velocity flow coming from the fixed set 2 (lying in the range U to 2U) from the leakage flow which is confined between the disk 9 and the diaphragm 4 and which is sucked into the scoops 15 and which has a velocity of about 0.4 U. The operation of the scoops 15 is thus further improved.

The fluid leaving the ducts 12 serves to feed the sealing means of the diaphragm of the following stage whose flow rate which is generally close to the flow rate 10 is equal to the flow rate 19 leaving the ducts 12.

I claim:

1. An impulse turbine stage comprising a set (1) of fixed vanes (2) fixed to the stator (3) of the turbine and supporting a diaphragm (4), followed by a set (7) of moving vanes (8) mounted on a disk (9) fixed to the rotor (6) of the turbine, the stage being characterized in that said disk (9) is provided with through ducts (12) parallel to the axis of the rotor (6) and in that the inlets to said ducts (12) opening out into the gap between the diaphragm (6) and the disk (9) are provided with scoops (15) open sideways in the direction of rotation to direct fluid into the ducts (12).

2. An impulse turbine stage according to claim 1, characterized in that each scoop (15) is constituted by the end of a thimble (13) fixed in the duct (12) with half of the base (14) of the thimble and of its cylindrical portion projecting from the disk (19) being removed back to an axial plane of the turbine.

3. An impulse turbine stage according to claim 1 characterized in that the diaphragm (4) of the set (1) of fixed vanes (2) is provided with a circumferential groove (17) facing the row of scoops (15).

4. An impulse turbine stage according to claim 1 characterized in that the diaphragm (4) of the set (1) of fixed vanes (2) and the disk (9) of the set (7) of moving vanes (8) are provided with sealing means (18) in the vicinity of the roots of the vanes (2, 8).

* * * * *